US005578434A

United States Patent [19]

Moizo et al.

[11] Patent Number: 5,578,434

[45] Date of Patent: Nov. 26, 1996

[54] PHOTOGRAPHIC SILVER HALIDE DEVELOPER COMPOSITION AND PROCESS FOR FORMING PHOTOGRAPHIC SILVER IMAGES

[75] Inventors: Elda Moizo, Carcare; Carlo Marchesano, Savona, both of Italy; Andrew Mott, Bishop's Stortford, Great Britain; Dian E. Stevenson, Saffron Walden, England

[73] Assignee: Imation Corp., Woodbury, Minn.

[21] Appl. No.: 440,832

[22] Filed: May 15, 1995

[30] Foreign Application Priority Data

Jun. 27, 1994 [EP] European Pat. Off. ..... 94109868

[51] Int. Cl.[6] ..... G03C 5/30

[52] U.S. Cl. ..... 430/480; 430/483; 430/485; 430/489; 430/490; 430/492

[58] Field of Search ..... 430/435, 436, 430/440, 441, 464, 480, 483, 485, 374, 372, 428, 429, 490, 468, 467, 446, 489, 492

[56] References Cited

U.S. PATENT DOCUMENTS

| | | | |
|---|---|---|---|
| 3,821,000 | 6/1974 | Land et al. | 430/228 |
| 4,353,974 | 10/1982 | Webb et al. | 430/218 |
| 4,468,448 | 8/1984 | Rogers | 430/222 |
| 4,853,318 | 8/1989 | Fujita et al. | 430/464 |
| 5,236,816 | 8/1993 | Purol et al. | 430/492 |
| 5,342,741 | 8/1994 | Morimoto et al. | 430/434 |
| 5,419,997 | 5/1995 | Hirano | 430/435 |

FOREIGN PATENT DOCUMENTS

0573700A1 12/1993 European Pat. Off. .

WO93/11456 6/1993 WIPO .

OTHER PUBLICATIONS

James, *The Theory of the Photographic Process,* 4th Ed. 1977, pp. 476–478.

*Primary Examiner*—Lee C. Wright

*Attorney, Agent, or Firm*—Mark A. Litman; Gregory A. Evearitt

[57] ABSTRACT

The present invention relates to a black-and-white aqueous alkaline photographic developer composition, free of dihydroxybenzene developing agent, comprising a reductic acid developing agent and an auxiliary superadditive developing agent, wherein the reductic acid developing agent is represented by the formula (I):

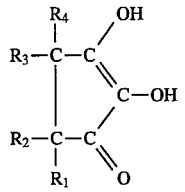

wherein, $R_1$, $R_2$, $R_3$ and $R_4$ each are selected from the group consisting of hydrogen and group $CH_2R_5$, wherein $R_5$ is hydrogen or a monovalent group, e.g. amino, cyano, halogen, hydroxyl, carboxyl, sulfonyl, alkyl, cycloalkyl, aryl.

A process for forming a black-and-white photographic silver image comprising developing a silver halide photographic element with said black-and-white aqueous alkaline photographic developer composition is also described.

13 Claims, No Drawings

PHOTOGRAPHIC SILVER HALIDE DEVELOPER COMPOSITION AND PROCESS FOR FORMING PHOTOGRAPHIC SILVER IMAGES

FIELD OF THE INVENTION

The present invention refers to photographic silver halide developer composition and to a process for forming a black-and-white image by using a developing solution which is environmentally advantageous.

BACKGROUND OF THE INVENTION

Black-and-white silver halide photographic elements are typically processed in aqueous alkaline developing solutions containing a dihydroxy-benzene developing agent, such as hydroquinone. While development processes based on the use of hydroquinone generally provide very good sensitometric results, they are disadvantageous with regard to ecological and environmental considerations. In particular, hydroquinone and its derivatives, and the oxidized forms thereof, have become of increasing concern in recent years from the point of view of potential toxicity and environmental pollution. Thus, there is an urgent need in the art for a free of hydroquinone development process which produces the same good results of the known development process containing hydroquinone, but which is environmentally more advantageous.

Developing solutions free of hydroquinone and using ascorbic acid developing agents have been used heretofore in a wide variety of photographic developing processes. Thus, for example, developing compositions containing ascorbic acid developing agents have been disclosed in U.S. Pat. Nos. 2,688,548; 2,688,549: 3,922,168; 3,942,985; 4,168,977; 4,478,928; 4,650,746 and 4,975,354.

Recently, several patents have been disclosed on the subject. U.S. Pat. No. 5,098,819 describes a photographic developer composition comprising a developer selected from the group consisting of ascorbic acid and its sugar-type derivatives, their salts and mixture thereof, together with a sulfite, an alkali metal carbonate and a 3-pyrazolidone developer compound.

U.S. Pat. No. 5,147,767 discloses an environmentally-safe, non-toxic non-hydro-quinone and non-alkali metal hydroxide containing photographic developer composition comprising a developer selected from the group consisting of 2-keto gluconic acid and derivatives thereof, together with a sulfite, an alkali metal carbonate and a 3-pyrazolidone developer compound.

WO 93-11,456 discloses a system for rapid access processing of photographic silver halide elements comprising, in combination, a photographic silver halide element of the type containing a hydrazine compound and a developer solution comprising at least one ascorbic acid developing agent selected from the group consisting of ascorbic acid, derivatives thereof and salts of either.

U.S. Pat. No. 5,236,816 describes a photographic developing solution which is free of dihydroxybenzene developing agents, has a pH in the range of from 9.5 to 11.5 and comprises (1) and ascorbic acid developing agent, (2) an auxiliary super-additive developing agent and (3) a carbonate buffering agent in a concentration of at least 0.5 molar. The developing solution is particularly useful in a process for forming a high contrast image in the graphic arts field utilizing a silver halide photographic element comprising a hydrazine compound which functions as a nucleating agent and an amino compound which functions as an incorporated booster. Said developing solution is not particularly useful when a non-nucleated film, for example a radiographic film must be developed.

EP 573,700 discloses a process for developing a silver halide photographic material in a continuous automatic way using a developer solution containing an ascorbic acid analogue or derivative and a 3-pyrazolidone derivative as developing agents and replenishing the developer solution with a replenishing composition having a defined pH.

Developing solutions containing ascorbic acid as main developing agent have the advantage of providing an environmentally favorable alternative to the use of developing solutions containing dihydroxybenzene developing solutions. However, said developing solutions containing ascorbic acid as main developing agent have the disadvantage of poor resistance against aerial oxidation and cannot be left in continuous transport automatic processors for several days without undergoing a dramatic decrease in developing activity. In particular, the pH value of developing solutions containing ascorbic acid must be kept under careful control. In addition, an other disadvantage of said developing solutions is that they are useful in the graphic arts film when a high contrast image is to be obtained, while they are not useful in the radiographic field, where a high contrast image is not desired.

Reductone compounds, and more specifically reductic acid and its derivatives, have been described as compounds useful in silver halide photographic materials. For example, U.S. Pat. No. 4,839,258 discloses a super-high contrast negative type silver halide photographic material comprising a support having provided thereon at least one silver halide emulsion layer containing a) a hydrazine derivative, b) a compound selected from reductones and c) a 6-membered heterocyclic compound having at least 2 nitrogen atoms. Useful reductone compounds are, for example, ascorbic acid, reductic acid, dimethyl reductone and the like. The developer composition used to treat this type of material is a standard developing solution for black-and-white development containing hydroquinone compound as primary developing agent.

Reductic acid derivatives are also known as developing agents for silver diffusion transfer processes, as described in U.S. Pat. No. 3,821,000, wherein the process comprises the steps of a) exposing a film unit comprising photosensitive silver halide, b) contacting said exposed film with processing solution containing an a,b-enediol silver halide developing agent, i.e. tetramethyl reductic acid, thereby providing a visible silver image to said unit as a function of the point-to-point degree of exposure thereof, and c) contacting said silver image with a noble metal ion below silver in the Electromotive Force Series of Elements. In addition, U.S. Pat. Nos. 4,386,151, 4,468,448, 4,4468,449, 4,468,450 and 4,468,451 disclose photographic processes and products for forming an image dye from a colorless precursor of a preformed dye image, the dye having a moiety that undergoes cleavage in the presence of silver ion and/or soluble silver complex. The processing composition comprising tetramethyl reductic acid as the only developing agent, an auxiliary developing agent being not present in said developing solution.

U.S. Pat. No. 4,353,974 describes a process for the production of a photographic image which comprises exposing a photographic assembly containing a hydroxypyridone azamethine compound, treating the exposed photographic assembly with an aqueous alkaline processing bath containing silver halide developer and, in the non-latent image areas, allowing the silver halide developer to diffuse to bleach said azamethine compound to form a photographic dye image. The developer may be hydroquinone, aminophenol, pyrazolidinone, ascorbic acid, a mixture thereof, or some more unusual developers such as reductic acid derivatives.

It could be desirable to provide a black-and-white developing solution, useful both in graphic arts and radiographic fields, free of dihydroxybenzene developing agent, and being stable against aerial oxidation.

SUMMARY OF THE INVENTION

The present invention relates to a black-and-white aqueous alkaline photographic developer composition, free of dihydroxybenzene developing agent, comprising a reductic acid developing agent and an auxiliary super-additive developing agent, wherein the reductic acid developing agent is represented by the formula (I):

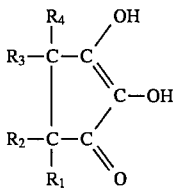

(I)

wherein each of $R_1$, $R_2$, $R_3$ and $R_4$ is selected from the group consisting of hydrogen and $CH_2R_5$, wherein $R_5$ is hydrogen or a monovalent group, preferably a monovalent organic group, e.g. amino, cyano, halogen, hydroxyl, carboxyl, sulfonyl, alkyl, cycloalkyl, aryl.

This black-and-white developing composition is useful both in graphic arts and radiographic fields, is more environmentally friendly due to the absence of dihydroxybenzene in the developing agent, and is stable against aerial oxidation, maintaining a stable pH value.

DETAILED DESCRIPTION OF THE INVENTION

In the previous formula, each of $R_1$, $R_2$, $R_3$ and $R_4$ is selected from the group consisting of hydrogen and $CH_2R_5$, wherein $R_5$ is hydrogen or a monovalent group, e.g. amino, cyano, halogen, (e.g. fluoro, chloro), hydroxyl, carboxyl, sulfonyl, alkyl from 1 to 4 carbon atoms (e.g. methyl, ethyl, propyl), cycloalkyl, aryl from 6 to 10 carbon atoms (e.g. phenyl, naphthyl). The alkyl and aryl groups may be substituted with hydroxyl, carboxyl, sulfonyl, halogen, amino. Preferably, each of $R_1$, $R_2$, $R_3$ and $R_4$ is hydrogen or an alkyl group such as methyl or ethyl; most preferably, $R_1$ to $R_4$ are all methyl groups.

The synthesis of tetramethyl reductic acid can been carried out by using methods described in L. Claise, *Liebigs Annaten der Chemie,* 1876, 180, 1–22, F. Francis and F. G. Willson, *Journal of the Chemical Society,* 1913, 2238–2247 and G. Hesse and B. Wehling, *Liebigs Annaten der Chemie,* 1964, 679, 100–106.

The amount of such developing agent used in the present invention is from about 0.02 to 0.8 moles per liter, preferably from about 0.08 to 0.3.

The auxiliary developing agents showing a superadditive effect are well known in the art, as described in Mason, "Photographic Processing Chemistry", Focal Press, London, 1975.

For the purpose of the present invention, the preferred superadditive auxiliary developing agents are those described in U.S. Pat. No. 5,236,816; particularly useful are the superadditive auxiliary developing agents such as aminophenol and substituted aminophenol (e.g. N-methyl-p-aminophenol, also known as Metol and 2,4-diaminophenol) and pyrazolidones (e.g. 1-phenyl-3-pyrazolidone, also known as Phenidone) and substituted pyrazolidones (e.g. 1-phenyl-4-methyl-3-pyrazolidone, 1-phenyl-4-methyl-4-hydroxymethyl-3-pyrazolidone, also-known as Dimezone S, and 1-phenyl-4,4'-dimethyl-3-pyrazolidone, also known as Dime-zone).

The amount of such superadditive auxiliary developing agent used in the present invention is from about 0.0001 to 0.15 moles per liter, preferably from about 0.0025 to 0.1.

The aqueous alkaline developing compositions of this invention contain an antioxidant compound in a quantity sufficient to give good stability characteristics. Useful antioxidant compounds include the sulfite preservatives, i.e. any sulfur compound capable of forming sulfite ions in aqueous solutions, such as alkali metal or ammonium sulfites, bisulfites, metabisulfites, sulfurous acid and carbonyl-bisulfite adducts. Typical examples of sulfite preservatives include sodium sulfite, potassium sulfite, lithium sulfite, ammonium sulfite, sodium bisulfite, potassium metabisulfte, sodium metabisulfite, bisulfite-formaldehyde addition compound sodium salt, and the like.

Antifoggant agents, known in the art to eliminate fog on the developed photographic silver halide films, can be used in the developer compositions of this invention. They include, for example, organic antifoggant agents, such as derivatives of benzimidazole, benzotriazole, tetrazole, imidazole, indazole, thiazole. etc., used alone or in combination. The organic antifoggants are well known as discussed, for example, in Mees, *The Theory of the Photographic Process,* 3rd Edition, 1966, p. 344–346. Derivatives of benzotriazole are preferred in the practice of this invention, as described in EP 182,293. Said derivatives include lower alkyl groups (having 1 to 4 carbon atoms), such as 5-methylbenzotriazole, lower alkoxy groups (having 1 to 4 carbon atoms) or halogen (chlorine) substituted benzotriazole antifoggant agents.

At least an inorganic alkali agent is used in the developer compositions of this invention to achieve the preferred pH range which normally is above 10. The inorganic alkali agent includes KOH, NaOH, potassium and sodium carbonate, etc.

Other adjuvants well known in the art are comprised in the developer compositions of this invention. These include inorganic antifogging agents such as soluble halides (e.g., KBr and NaBr) and sequestering agents such as aminopolycarboxylic acid compounds (e.g., nitrilotriacetic acid (NTA), ethylenediaminotetracetic acid (EDTA), diethylenetriaminopentacetic acid (DTPA), diaminopropanoltetracetic acid (DPTA) and ethylendiamino-N,N,N',N'-tetrapropionic acid (EDTP)), α-hydroxycarboxylic acid compounds (e.g., lactic acid), dicarboxylic acid compounds (e.g. oxalic acid and malonic acid), polyphosphate compounds (e.g., sodium hexamataphosphate) or diphosphonic acid compounds (e.g., dialkylaminomethane diphosphonic acid as described in U.S. Pat. No. 4,873,180).

According to the present invention, the photographic silver halide developer composition contains a buffering agent chosen among carbonate, borate and phosphate compounds, the carbonate and borate compounds being preferred. The buffering agents include, for example, sodium carbonate, potassium carbonate, sodium bicarbonate and potassium bicarbonate.

The aqueous alkaline photographic developer composition of this invention can vary widely with respect to the concentration of the various ingredients included therein. Typically, the reductic acid derivative developing agent is used in an amount of from about 0.020 to about 0.80 moles per liter, preferably in an amount of from about 0.08 to about 0.30 moles per liter; the auxiliary developing agent is used in an amount of from about 0.0001 to about 0.15 moles per liter, preferably in an amount of from about 0.0005 to about 0.01 moles per liter; the inorganic antifogging agent is used in an amount of from about 0.001 to about 0.2 moles per liter, preferably in an amount of from about 0.01 to about 0.05 moles per liter; the antioxidant compound (such as the sulfite preservative) is used in an amount of from about 0.001 to about 1 moles per liter, preferably in an amount of from about 0.08 to about 0.7 moles per liter of solution; the organic antifogging compound is used in an amount of from about $1\times10^{-5}$ to about $5\times10^{-2}$ moles per liter, preferably in an amount of from about $5\times10^{-4}$ to about $1\times10^{-2}$ moles per liter; the buffering agent is used in an amount from about 0.20 to about 1 moles per liter and the sequestering agent is used in an amount of from about $1\times10^{-4}$ to about 0.2 moles per liter, preferably in an amount of from about $5\times10^{-3}$ to about 0.1 moles per liter.

According to the present invention, it is deemed to be significant to evaluate the stability of the developing composition of the present invention as absorbance variation (measured at 450 nm) when a sample of 100 ml developer solution is stored under room conditions in a 1000 ml open "volumetric flask", a flat-bottomed flask with a long neck, in contact with air for significant times, for instance of one, two or three days (from a practical point of view two days and, still better, three days are a particularly significant time since they represent a week-end work stop).

Making reference to a three-day period of time, the stability of a developing bath can be said to be significantly improved according to the present invention when the absorbance, measured under the above specified conditions with a LAMBDA 5 spectrophotometer of Perkin Elmer, tends to remain at the same levels, i.e. with a variation lower than 0.1.

Of course, both the pH of the solution and the storing temperature will affect the obtained results. The higher the values of such variables, the higher in general the measured absorbance values.

Alternatively and preferably additionally, a developer composition can be considered to be stable when its pH is stable. In the present invention, a developer composition can be considered to be unstable when after three days under the above reported conditions its pH varies an absolute value of at least 0.2 units when the pH is measured four times after mixing: 1) at mixing (as the base pH), 2) 24 hours after mixing, 3) 48 hours after mixing, and 4) 72 hours after mixing. Each "change" being a measurement of the difference in pH from the previous pH reading. The developing composition can be considered to be stable when pH varies of an absolute value lower than 0.2 units. The term "absolute value" obviously means that the total variation and the single variations it consists of are counted independently from their sign: a first variation from 0 to −0.2 and a further variation from −0.2 to +0.2, for instance, herein mean a total variation in absolute value of 0.6.

The developer composition of the present invention can be usually made as single concentrated liquid part that is then diluted with water in automatic processors by the use of a mixer, in order to have a ready-to-use solution. A method of making a concentrated alkaline photographic composition packaged in a single concentrated part to be diluted with water to form a ready-to-use solution is shown, for example, in U.S. Pat. No. 4,987,060.

The developer compositions of the present invention are useful in a process for treating a silver halide photographic element which can be used for any general black and white photography, graphic arts, X-ray, print, microfilm, color reversal (i.e., in the black and white development step of a color reversal process), and the like.

In particular, useful photographic elements which can be used in this invention are silver chloride emulsion elements as conventionally employed in forming halftone, dot, and line images usually called "lith" elements. Said elements contain silver halide emulsions comprising preferably at least 50 mole % of silver chloride, more preferably at least 80 mole % of silver chloride, the balance, if any, being silver bromide. If desired, said silver halides can contain a small amount of silver iodide, in an amount that is usually less than about 5 mole %, preferably less than 1 mole %. The average grain size of silver halide used in lith emulsions is lower than about 0.7 micrometers, preferably lower than 0.4 micrometers, more preferably lower than 0.2 micrometers. Other references to lith materials can be found in Research Disclosure 235, Item 23510, November 1983.

The developer compositions of the present invention are also useful in a process for forming high contrast silver images by development of a photographic element including a negative acting surface latent image-type silver halide emulsion lawyers in reactive association with a hydrazine compound and a contrast promoting agent.

The contrast promoting agent compound can be incorporated in the photographic element or in the developing solution or both in the developing solution and in the photographic element.

Preferred contrast promoting agents, which can be incorporated in the developing solution, include hydroxymethylidine group containing compounds, such as diarylmethanol compounds, as described in U.S. Pat. No. 4,693,956. Examples of diarylmethanol contrast promoting agents are methyl alcohol, benzhydrol, 1,3-butanediol, 1,4-cyclohexanediol, phenylmethylcarbinol and the like.

Preferred contrast promoting agents, which can be incorporated in the photographic element, include diarylcarbinol compounds as described in U.S. Pat. No. 4,777,118. Examples of diarylcarbinol contrast promoting agents are benzhydrol, 4,4'-dimethoxydiphenyhnethanol, 4,4'-dimethyldiphenylmethanol, 2,2'-di-bromodiphenylmethanol, and the like.

Other contrast promoting agents useful for high contrast images are for examples the alkanolamine compounds comprising a hydroxyalkyl group of 2 to 10 carbon atoms and a mercapto compound, as described in U.S. Pat. No. 4,668,605 or certain trialkyl amines, monoalkyl-dialkanolamines or dialkylmonoalkanol amines, as described in U.S. Pat. No. 4,740,452. Useful contrast promoting agents also include certain amino compounds which function as incorporated booster described in U.S. Pat. No. 4,975,354. These amino compounds contain within their structure a group comprised of at least three repeating ethylenoxy units.

The amount of said contrast promoting agent is from about $10^{-4}$ to $10^{-1}$ mole per mole of silver, more preferably from about $10^{-3}$ to $5\times10^{-2}$ mole per mole of silver.

The silver halide emulsion layer includes negative acting surface latent image-type silver halide grains in reactive association with a hydrazine compound.

Preferably the hydrazine compound is incorporated into the photographic element, for example in a silver halide emulsion layer or in a hydrophilic colloidal layer, preferably a hydrophilic colloidal layer adjacent to the emulsion layer in which the effects of the hydrazine compound are desired. It can, of course, be present in the photographic element distributed between the emulsion and the hydrophilic colloidal layers, such as subbing layers, interlayers and protective layers.

Hydrazine compounds to be incorporated into the photographic element are those disclosed in GB 598,108 and in U.S. Pat. Nos. 2,419,974; 4,168,977; 4,323,643; 4,224,401; 4,272,614; 2,410,690; 4,166,742; 4,221,857; 4,237,214; 4,241,164; 4,243,739; 4,272,606; 4,311,871; 4,332,878; 4,337,634; 4,937,160 and 5,190,847 and in Research Disclosure No. 235, November 1983, Item 23510 "Development nucleation by hydrazine and hydrazine derivatives".

In particular, useful photographic elements which can be processed with the developer composition of this invention for forming high contrast images contain silver halide emulsions that may be silver chloride, silver chloro-bromide, silver iodo-bromide, silver iodo-chloro-bromide or any mixture thereof. Generally, the iodide content of the silver halide emulsions is less than about 10% iodide moles, said content being based on the total silver halide. The silver halide emulsions are usually monodispersed or narrow grain size distribution emulsions, as described for examples in U.S. Pat. No. 4,166,742; 4,168,977; 4,224,401; 4,237,214; 4,241,164; 4,272,614 and 4,311,871. The silver halide emulsions may comprise a mixture of emulsions having different grain combinations, for example a combination of an emulsion having a mean grain size above 0.7 micrometers, as described in JP 57-58137 or a combination of two emulsions, both having a grain size below 0.4 micrometers, such as for example a first silver halide emulsion having a mean grain size of 0.1 to 0.4 micrometers and a second silver halide emulsion with particles having a mean grain volume lower than one half the particles of the first emulsion.

Silver halide photographic elements for X-ray exposures which can be processed in the developer compositions of the present invention comprise a transparent film base, such as polyethyleneterephthalate and polyethylene-naphthalate film base, having on at least one of its sides, preferably on both its sides, a silver halide emulsion layer.

The silver halide grains in the radiographic emulsion may be regular grains having a regular crystal structure such as cubic, octahedral, and tetradecahedral, or a spherical or irregular crystal structure, or those having crystal defects such as twin planes, epitaxialisation, or those having a tabular form, or combinations thereof.

The term "cubic grains" according to the present invention is intended to include substantially cubic grains, that is, silver halide grains which are regular cubic grains bounded by crystallographic faces (100), or which may have rounded edges and/or vertices or small faces (111), or may even be nearly spherical when prepared in the presence of soluble iodides or strong ripening agents, such as ammonia. The silver halide grains may be of any required composition for forming a negative silver image, such as silver chloride, silver bromide, silver chlorobromide, silver bromoiodide, silver bromochloroiodide, and the like. Particularly good results are obtained with silver bromoiodide grains, preferably silver bromoiodide grains containing about 0.1 to 15% moles of iodide ions, more preferably about 0.5 to 10% moles of iodide ions and still preferably silver bromoiodide grains having average grain sizes in the range from 0.2 to 3 μm, more preferably from 0.4 to 1.5 μm. Preparation of silver halide emulsions comprising cubic silver halide grains is described, for example, in Research Disclosure, Vol. 176, December 1978, Item 17643, Vol. 184, August 1979, Item 18431 and Vol 308, December 1989, Item 308119.

Other silver halide emulsions for radiographic elements having highly desirable imaging characteristics are those which employ one or more light-sensitive tabular grain emulsions as disclosed in U.S. Pat. Nos. 4,425,425 and 4,425,426. The tabular silver halide grains contained in the silver halide emulsion layers have an average diameter to thickness ratio (often referred to in the art as aspect ratio) of at least 2:1, preferably 3:1 to 20:1, more preferably 3:1 to 10:1, and most preferably 3:1 to 8:1. Average diameters of the tabular silver halide grains range from about 0.3 μm to about 5 μm, preferably 0.5 μm to 3 μm, more preferably 0.8 μm to 1.5 μm. The tabular silver halide grains have a thickness of less than 0.4 preferably less than 0.3 μm and more preferably less than 0.2 μm.

The tabular silver halide grain characteristics described above can be readily ascertained by procedures well known to those skilled in the art. The term "diameter" is defined as the diameter of a circle having an area equal to the projected area of the grain. The term "thickness" means the distance between two substantially parallel main planes constituting the tabular silver halide grains. From the measure of diameter and thickness of each grain the diameter to thickness ratio of each grain can be calculated, and the diameter to thickness ratios of all tabular grains can be averaged to obtain their average diameter to thickness ratio. By this definition the average diameter to thickness ratio is the average of individual tabular grain diameter to thickness ratios. In practice, it is simpler to obtain an average diameter and an average thickness of the tabular grains and to calculate the average diameter to thickness ratio as the ratio of these two averages. Whatever the method used may be, the average diameter to thickness ratios obtained do not differ greatly.

In the silver halide emulsion layer containing tabular silver halide grains, at least 15%,, preferably at least 25%, and, more preferably, at least 50% of the silver halide grains are tabular grains having an average diameter to thickness ratio of not less than 3:1. Each of the above proportions, "15%", "25%" and "50%" means the proportion of the total projected area of the tabular grains having an average diameter to thickness ratio of at least 3:1 and a thickness lower than 0.4 μm, as compared to the projected area of all of the silver halide grains in the layer.

As described above, commonly employed halogen compositions of the silver halide grains can be used. Typical silver halides include silver chloride, silver bromide, silver chloroiodide, silver bromoiodide, silver chlorobromoiodide and the like. However, silver bromide and silver bromoiodide are preferred silver halide compositions for tabular silver halide grains with silver bromoiodide compositions containing from 0 to 10 mol % silver iodide, preferably from 0.2 to 5 mol % silver iodide, and more preferably from 0.5 to 1.5 mol % silver iodide. The halogen composition of individual grains may be homogeneous or hetero-geneous.

Silver halide emulsions containing tabular silver halide grains can be prepared by various processes known for the preparation of radiographic elements. Silver halide emulsions can be prepared by the acid process, neutral process or ammonia process, or in the presence of any other silver halide solvent. In the stage for the preparation, a soluble silver salt and a halogen salt can be reacted in accordance with the single jet process, double jet process, reverse mixing process or a combination process by adjusting the conditions in the grain formation, such as pH, pAg, temperature, form and scale of the reaction vessel, and the reaction method. A silver halide solvent, such as ammonia, thioethers, thioureas, etc., may be used, if desired, for controlling grain size, form of the grains, particle size distribution of the grains, and the grain-growth rate.

Preparation of silver halide emulsions containing tabular silver halide grains is described, for example, in de Cugnac and Chateau, "Evolution of the Morphology of Silver Bromide Crystals During Physical Ripening", Science and Industries Photographiques, Vol. 33, No.2 (1962), pp.121–125, in Gutoff, "Nucleation and Growth Rates During the Precipitation of Silver Halide Photographic Emulsions", Photographic Science and Engineering, Vol. 14, No. 4 (1970), pp. 248–257,in Berry et al., "Effects of Environment on the Growth of Silver Bromide Microcrystals", Vol.5, No.6 (1961), pp. 332–336, in U.S. Pat. Nos. 4,063,951, 4,067,739, 4,184,878, 4,434,226, 4,414,310, 4,386,156, 4,414,306 and in EP Pat. Appln. No. 263,508.

In preparing the silver halide emulsions for photographic elements, a wide variety of hydrophilic dispersing agents for the silver halides can be employed. Gelatin is preferred, although other colloidal materials such as gelatin derivatives, colloidal albumin, cellulose derivatives or synthetic hydrophilic polymers can be used as known in the art. Other hydrophilic materials useful known in the art are described, for example, in Research Disclosure, Vol. 308, Item 308119, Section IX. The amount of gelatin employed in a radiographic element is such as to provide a total silver to gelatin ratio higher than I (expressed as grams of Ag/grams of gelatin). In particular the silver to gelatin ratio of the silver halide emulsion layers is in the range of from 1 to 1.5.

The radiographic element which can be developed with the developer composition of the present invention can be forehardened to provide a good resistance in rapid processing conducted in automatic processing machine without the use of hardeners in processing solutions. Examples of gelatin hardeners are aldehyde hardeners, such as formaldehyde, glutaraldehyde and the like, active halogen hardeners, such as 2,4-dichloro-6-hydroxy- 1,3,5-triazine, 2-chloro-4,6-hydroxy- 1,3,5-triazine and the like, active vinyl hardeners, such as bis-vinylsulfonyl-methane, 1,2-vinylsulfonylethane, bis-vinylosulfonyl-methyl ether, 1,2-bis-vinylsulfonylethyl ether and the like, N-methylol hardeners, such as dimethylolurea, methyloldimethyl hydantoin and the like, and bi-, tri-, or tetra-vinylsulfonyl substituted organic hydroxy compounds, such as 1,3-bis-vinylsulfonyl-2-propanol and the like. Other useful gelatin hardeners may be found in Research Disclosure, Vol. 308, December 1989, Item 308119, Paragraph X.

The above described gelatin hardeners may be incorporated in the silver halide emulsion layer or in a layer of the silver halide radiographic element having a water permeable relationship with the silver halide emulsion layer. Preferably, the gelatin hardeners are incorporated in the silver halide emulsion layer.

The amount of the above described gelatin hardener that is used in the silver halide emulsion of the radiographic element of this invention can be widely varied. Generally, the gelatin hardener is used in amounts of from 0.5 % to 10% by weight of hydrophilic dispersing agent, such as the above described highly deionized gelatin, although a range of from 1% to 5 % by weight of hydrophilic dispersing agent is preferred.

The gelatin hardeners can be added to the silver halide emulsion layer or other component layers of the radiographic element utilizing any of the well-known techniques in emulsion making. For example, they can be dissolved in either water or a water-miscible solvent such as methanol, ethanol, etc. and added into the coating composition for the above mentioned silver halide emulsion layer or auxiliary layers.

The silver halide emulsions can be chemically and optically sensitized by known methods.

Spectral sensitization can be performed with a variety of spectral sensitizing dyes known in the art. An example of such spectral sensitizing dyes is the polymethine dye class, including cyanines, complex cyanines, merocyanines, complex merocyanines, oxonols, hemioxonols, styryls, merostyryls and streptocyanines.

Although native UV-blue sensitivity of silver halides is usually known in the art, significant advantage can be obtained by the use of spectral sensitizing dyes, even when their principal absorption is in the spectral region to which the silver halide emulsion have their native sensitivity.

Preferably, spectral sensitizing dyes according to this invention are those which exhibit J aggregates if adsorbed on the surface of the silver halide grains and a sharp absorption band (J-band) with a bathocromic shift with respect to the absorption maximum of the free dye in aqueous solution. Spectral sensitizing dyes producing J aggregates are well known in the art, as illustrated by F. M. Hamer, *Cyanine Dyes and Related Compounds,* John Wiley and Sons, 1964, Chapter XVII and by T. H. James, *The Theory of the Photographic Process,* 4th edition, Macmillan, 1977, Chapter 8. The use of J-band exhibiting dyes allows the reduction of the well-known problem of crossover.

The silver halide emulsion layers can contain other constituents generally used in photographic products, such as binders, hardeners; surfactants, speed-increasing agents, stabilizers, plasticizers, gelatin extenders, optical sensitizers, dyes, ultraviolet absorbers, etc., and reference to such constituents can be found, for example, in Research Disclosure, Vol. 176, December 1978, Item 17643, Vol. 184, August 1979, Item 18431 and Vol 308, December 1989, Item 308119.

The photographic elements can be prepared by coating the light-sensitive silver halide emulsion layers and other auxiliary layers on a support. Examples of materials suitable for the preparation of the support include glass, paper, polyethylene-coated paper, metals, polymeric film such as cellulose nitrate, cellulose acetate, polystyrene, polyethylene terephthalate, polyethylene naphthalenate, polyethylene, polypropylene and other well known supports. Preferably, the silver halide emulsion layers are coated on the support at a total silver coverage of at least 1 $g/m^2$, preferably in the range of from 2 to 5 $g/m^2$.

Auxiliary layers can be represented by top-coating layers, antistatic layers, antihalo layer, protective layers, dye underlayers, and the like. Dye underlayers are particularly useful in order to reduce the crossover of the double coated silver halide radiographic material. Reference to well-known dye underlayer can be found in U.S. Pat. No. 4,900,652, U.S. Pat. No. 4,855,221, U.S. Pat. Nos. 4,857,446, 4,803,150. According to a preferred embodiment, a dye underlayer is coated on at least one side of the support, more preferably on both sides of the support, before the coating of said at least two silver halide emulsions.

The radiographic element is associated with the intensifying screens so as to be exposed to the radiations emitted by said screens. The pair of screens employed in combination with the radiographic element is symmetrical or unsymmetrical. The screens are made of relatively thick phosphor layers which transform the X-rays into light radiation (e.g., visible light). The screens absorb a portion of X-rays much larger than the radiographic element and are used to reduce the radiation dose necessary to obtain a useful image.

The phosphors used in the intensifying screens have an emission maximum wavelength in the ultraviolet, blue, green, red or infrared region of the electromagnetic spectrum according to the region of the electromagnetic spectrum to which said at least two silver halide emulsion layers are sensitive. More preferably, said phosphors emit radiations in the ultraviolet, blue and green regions of the electromagnetic spectrum.

The green emitting phosphors emit radiation having more than about 80% of its spectral emission above 480 nm and its maximum of emission in the wavelength range of 530–570 nm. Green emitting phosphors which may be used in the intensifying screens include rare earth activated rare earth oxysulfide phosphors of at least one rare earth element selected from yttrium, lanthanum, gadolinium and lutetium, rare earth activated rare earth oxyhalide phosphors of the same rare earth elements, a phosphor composed of a borate of the above rare earth elements, a phosphor composed of a phosphate of the above rare earth elements and a phosphor composed of tantalate of the above rare earth elements. These rare earth green emitting phosphors have been extensively described in the patent literature, for example in U.S. Pat. Nos. 4,225,653, 3,418,246, 3,418,247, 3,725,704, 3,617,743, 3,974,389, 3,591,516, 3,607,770, 3,666,676, 3,795,814, 4,405,691, 4,311,487 and 4,387,141. These rare earth phosphors have a high X-ray absorbing power and high efficiency of light emission when excited with X radiation and enable radiologists to use substantially lower X radiation dosage levels.

The binder employed in the fluorescent layer of the intensifying screens can be, for example, one of the binders commonly used in forming layers: gum arabic, protein such as gelatin, polysaccharides such as dextran, organic polymer binders such as polyvinylbutyral, polyvinylacetate, nitrocellulose, ethylcellulose, vinylidene-chloride-vinylchloride copolymer, polymethylmeth-acrylate, polybutylmethacrylate, vinyl-chloride-vinyl-acetate copolymer, polyurethane, cellulose acetate butyrate, polyvinyl alcohol, and the like.

Generally, the binder is used in an amount of 0.01 to 1 part by weight per one part by weight of the phosphor. However, from the viewpoint of the sensitivity and the sharpness of the screen obtained, the amount of the binder should preferably be small. Accordingly, in consideration of both the sensitivity and the sharpness of the screen and the easiness of application of the coating dispersion, the binder is preferably used in an amount of 0.03 to 0.2 parts by weight per one part by weight of the phosphor. The thickness of the fluorescent layer is generally within the range of 10 μm to 1 mm.

The following examples, which further illustrate the invention, report some experimental data which show the stability to aerial oxidation, the reduced Chemical Oxygen Demand (C.O.D.) and the good sensitometric properties of the developer compositions of the present invention.

EXAMPLE 1

Silver halide photographic developer solutions (1 to 7) were prepared according to the following table 1.

TABLE 1

| | 1 g/l | 2 g/l | 3 g/l | 4 g/l | 5 g/l | 6 g/l | 7 g/l |
|---|---|---|---|---|---|---|---|
| Water | 780 | 800 | 960 | 970 | 970 | 970 | 970 |
| KOH 35% | 85 | 97.5 | 12 | 20 | 20 | 20 | 20 |
| Diethanolamine | 8 | / | / | / | / | / | / |
| Dethylene Glycol | / | 15 | / | / | / | / | / |
| Ethylene Glycol | 2 | / | / | / | / | / | / |
| 4-Morpholinyl-Methylene Diphosphonic Acid | / | 7.5 | / | / | / | / | / |
| DTPA .5Na 40% | 3.8 | / | 1.8 | 2 | 2 | 2 | 2 |
| EDTA acid | / | 0.91 | / | / | / | / | / |
| Potassium Metabilsulfite | 20.48 | 46.8 | / | 10 | 10 | 10 | 10 |
| Potassium sulfite | / | / | 50 | / | / | / | / |
| Sodium metabilsulfite | 18 | / | / | / | / | / | / |
| Potassium bromide | 3.3 | 1.15 | 4 | 4 | 4 | 4 | 4 |
| Potassium carbonate | 10 | 13.25 | 100 | 50 | 50 | 50 | 50 |
| Benzotriazole | 0.29 | / | 0.2 | 0.2 | 0.2 | 0.2 | 0.2 |
| 1-Phenyl-1H-Tetrazole-5-Thiol | 0.30 | 0.03 | / | / | / | / | / |
| Phenidone | 0.38 | 1.16 | / | / | / | 2.5 | / |
| Dimezone S | / | / | 2.5 | / | / | / | 2.5 |
| N-Methyl-p-Amino-Phenol | / | / | / | / | 2.5 | / | / |
| Hydroquinone | 15 | 20 | / | / | / | / | / |
| Ascorbic Acid | / | / | 32 | / | / | / | / |
| Tetramethyl Reductic Acid | / | / | / | 25 | 25 | 25 | 25 |
| pH at 20° C. | 10.60 | 10.80 | 10.30 | 10.30 | 10.30 | 10.30 | 10.30 |

Developer solution 1, containing hydroquinone as developing agent, is a reference standard solution for developing graphic arts silver halide materials and is described in U.S. Pat. No. 4,987,060. Developer solution 2, containing hydroquinone as developing agent, is a reference standard solution for developing radiographic silver halide materials and is prepared as described in EP 559,061. Developer solution 3 is a reference solution described in U.S. Pat. No. 5,236,816, in which the hydroquinone developing agent has been replaced by the ascorbic acid compound. In the developer solution 4, the ascorbic acid developing agent of comparison solution 3 has been replaced by the tetramethyl reductic acid compound and there is no auxiliary developing agent. In the developer solutions 5 to 7 of the present invention, the ascorbic acid developing agent of comparison solution 3 has been replaced by the tetramethyl reductic acid compound and N-methyl-p-amino-phenol, phenidone and dimezone S have been respectively used as auxiliary developing agents.

Developer solutions 1 to 7 were checked through the following tests: samples of 100 ml of each developer were put into an open glass calibrated flask (capacity 1000 ml) and the oxidation test through a continuous air contact was made in stressed conditions by the use of Dubnoff thermostatic bath 38° C. and constant agitation for 8 hours/day. At regular intervals, pH at 20° C. and absorbance at 450 nm were measured. The higher and faster the increasing of these characteristics, the lower the stability against air oxidation of the developing solution. A developer solution is considered useful against aerial oxidation when it shows good results both considering the pH test and the absorbance test.

The values of the pH and of the absorbance at 450 nm for the developer solutions stored for different hours are respectively reported hereinbelow in Tables 2 and 3.

TABLE 2

| Developer | pH Values | | | |
|---|---|---|---|---|
| Solutions | Fresh | 24 hours | 48 hours | 72 hours |
| 1 (reference) | 10.55 | 11.50 | 11.97 | 11.64 |
| 2 (reference) | 10.80 | 11.32 | 11.87 | 12.09 |
| 3 (comparison) | 10.33 | 10.18 | 10.02 | 9.90 |
| 4 (comparison) | 10.33 | 10.27 | 10.23 | 10.23 |
| 5 (invention) | 10.33 | 10.32 | 10.31 | 10.31 |
| 6 (invention) | 10.30 | 10.29 | 10.24 | 10.23 |
| 7 (invention) | 10.33 | 10.30 | 10.28 | 10.24 |

TABLE 3

| Developer | Absorbance Values | | | |
|---|---|---|---|---|
| Solutions | Fresh | 24 hours | 48 hours | 72 hours |
| 1 (reference) | 0.02 | 0.15 | 0.94 | 3.00 |
| 2 (reference) | 0.01 | 0.20 | 0.85 | 3.00 |
| 3 (comparison) | 0.06 | 0.15 | 0.27 | 0.34 |
| 4 (comparison) | 0.07 | 0.08 | 0.07 | 0.07 |
| 5 (invention) | 0.50 | 0.55 | 0.57 | 0.67 |
| 6 (invention) | 0.10 | 0.10 | 0.13 | 0.13 |
| 7 (invention) | 0.30 | 0.28 | 0.28 | 0.28 |

The only solutions with stable pH and stable absorbance after 72 hours are the developer solution 4–7 containing tetramethyl reductic acid developing agent.

The Chemical Oxygen Demand (C.O.D.) is a measure of the quantity of oxidizable components present in the developing solutions. Since the carbon and hydrogen in organic matter are oxidized by chemical oxidants, the oxygen consumed is a measure only of the chemically oxidizable components and is dependant upon the oxidant, structure of the organic compounds and manipulative procedure. The standard developers with hydroquinone developing agent have very high C.O.D. values. In order to reduce the pollution caused by the chemical wastes, it is very important to have the maximum reduction in C.O.D. Table 4 shows the C.O.D. values of the different developer solutions.

TABLE 4

| Developer Solutions | COD (mg/liter) |
|---|---|
| 1 (reference) | 60,480 |
| 2 (reference) | 82,660 |
| 3 (comparison) | 42,336 |
| 4 (comparison) | 19,412 |
| 5 (invention) | 18,570 |
| 6 (invention) | 22,616 |
| 7 (invention) | 44,755 |

A considerable reduction of C.O.D. values has been noted in developer solutions containing tetramethyl reductic acid developing agent (developer solutions 4 to 7) compared to developer solutions containing hydroquinone developing agent (developer solutions 1 and 2). A reduction of C.O.D. values has been noted also with comparision developer solution 3, in which the hydroquinone has been replaced by ascorbic acid developing agent.

A cubic monodispersed 0.15 micrometers silver chlorobromide emulsion $AgBr_{0.40}Cl_{0.60}$ was prepared, gold and sulfur sensitized and coated onto a subbed polyester base at a silver coverage of 4.0 g/m$^2$ to form Film 1.

Strips of Film 1 were exposed in a sensitometer consisting of a 500 watt tungsten filament light source attenuated by a 0–4 continuous neutral image density wedge in contact with the film sample. Sensitometric tests were made by developing the exposed strips at a temperature of 35° C. and development time of 60 seconds using developer solutions 1 and from 3 to 7, then fixing at a temperature of 35° C. and fixing time of 30 seconds in a 3M Fix-Roll fixing solution. Sensitometric results include Dmin, Dmax, Speed, Toe contrast, Average contrast and Shoulder contrast. The higher the contrast, the better is the dot quality of the image obtained. The Toe contrast corresponds to the absolute value of the slope of the line joining the density points of 0.07 and 0.17 above Dmin. The Average contrast corresponds to the absolute value of the slope of the line joining the density points of 0.10 and 2.50 above Dmin and the Shoulder contrast corresponds to the absolute value of the slope of the line joining the density points of 1.60 and 4.00 above Dmin. Table 5 reports the sensitometric values.

TABLE 5

| Developer Solutions | Dmin | Dmax | Speed | Toe Contrast | Average Contrast | Shoulder Contrast |
|---|---|---|---|---|---|---|
| 1 (reference) | 0.03 | 5.14 | 1.25 | 1.19 | 5.64 | 10.00 |
| 3 (comparison) | 0.06 | 5.00 | 1.47 | 1.33 | 3.20 | 5.64 |
| 5 (invention) | 0.03 | 5.15 | 1.30 | 1.09 | 5.10 | 9.79 |
| 6 (invention) | 0.03 | 5.12 | 1.33 | 0.84 | 4.81 | 9.35 |
| 7 (invention) | 0.03 | 5.13 | 1.31 | 0.94 | 4.96 | 9.71 |

Table 5 shows that developer solutions 5 to 7 of the present invention containing tetramethyl reductic acid as developing agent and having auxiliary developing agents were able to produce sensitometric results comparable with those obtained by using a standard graphic arts developer solution 1 and much better than the results obtained by using comparison developer solution 3, containing ascorbic acid as main developing agent rather than tetramethyl reductic acid.

Comparison developer solution 4, containing tetramethyl reductic acid as the only developing agent with no auxiliary developing agent, was not useful to produce an image.

EXAMPLE 3

Strips of a high contrast Kodak 2000 ArI material (Film 5), containing an amino compound as incorporated booster, and an arylsulfonamidophenyl hydrazine as nucleating agent, as the one described in U.S. Pat. No. 4,988,604, were exposed and developed as in Example 1 using developer solution 7 (for 40 seconds) of the present invention, having the pH retouched at a value of 9.50 to obtain a visible image, and compared with comparison developer solution 3, containing ascorbic acid. The results, shown in Table 7, are comparable. The developer solution of the present invention has the advantage of a lower pH value (9.50 versus 10.30).

TABLE 7

| Developer Solutions | Films | Dmin | Dmax | Speed | Toe Contrast | Average Contrast | Shoulder Contrast |
|---|---|---|---|---|---|---|---|
| 3 (comparison) | 5 | 0.03 | 4.87 | 0.59 | 1.13 | 13.90 | 15.80 |
| 7 (invention) | 5 | 0.03 | 4.92 | 0.60 | 1.94 | 11.65 | 13.65 |

EXAMPLE 2

Strips of a graphic arts 3M EDG Film (Film 2) were exposed and developed as in Example 1. The 3M EDG Film comprised a cubic monodispersed silver chlorobromide emulsion $AgBr_{0.40}Cl_{0.60}$ having a mean grain size of 0.15 micrometers, gold and sulfur sensitized and coated onto a subbed polyester base at a silver coverage of 2.5 g/m$^2$.

Strips of a graphic arts 3M DRD Film (Film 3) were exposed and developed as in Example 1. The 3M EDG Film comprised a silver chlorobromide emulsion $AgBr_{0.16}Cl_{0.84}$ having a mean grain size of 0.09 micrometers, gold and sulfur sensitized and coated onto a subbed polyester base at a silver coverage of 2.3 g/m$^2$.

Strips of a graphic arts 3M DRC (Daylight Rapid Contact) Film (Film 4) were exposed and developed as in Example 1. The 3M DRC Film comprised a chlorobromide emulsion AgBr0.02Cl0.98 of narrow grain size distribution and mean grain size of 0.20 micrometers prepared by the conventional double jet procedure and coated onto a subbed polyester base at a silver coverage of 2.5 g/m$^2$.

EXAMPLE 4

A radiographic emulsion layer was coated on each side of a polyester support at a level of 2.15 g/m$^2$ of silver and 1.5 g/m$^2$ of gelatin per side. The emulsion comprised tabular silver bromide grains having an average diameter of 1.30 mm, an average thickness of 0.17 mm and an aspect ratio of 7.6, sulfur and gold chemically and spectrally sensitized to green light (Film 6).

A radiographic emulsion layer was coated on each side of a polyester support at a level of 2.00 g/m$^2$ of silver and 1.5 g/m$^2$ of gelatin per side. The emulsion comprised a 70:15:15 by weight blend of tabular silver bromide grains having an average grain size of 1.3 mm and an aspect ratio of 7.5:1, cubic silver bromoiodide grains having 2 mole percent iodide and an average grain size of 0.8 m, and an octahedral silver bromoiodide grains having 1.5 mole percent iodide and an average grain size of 0.4 m. The emulsion was sulfur and gold chemically and spectrally sensitized to green light.

TABLE 6

| Developer Solutions | Films | Dmin | Dmax | Speed | Toe Contrast | Average Contrast | Shoulder Contrast |
|---|---|---|---|---|---|---|---|
| 1 (reference) | 2 | 0.03 | 5.35 | 0.62 | 1.06 | 5.41 | 10.30 |
| 3 (comparison) | 2 | 0.25 | 5.29 | 1.19 | 0.70 | 5.19 | 4.74 |
| 7 (invention) | 2 | 0.04 | 5.30 | 0.69 | 0.86 | 4.75 | 9.09 |
| 1 (reference) | 3 | 0.05 | 5.54 | 2.20 | 1.44 | 4.80 | 8.19 |
| 3 (comparison) | 3 | 0.07 | 5.60 | 2.15 | 1.69 | 5.47 | 8.24 |
| 7 (invention) | 3 | 0.03 | 5.54 | 2.21 | 1.47 | 5.75 | 7.67 |
| 1 (reference) | 4 | 0.05 | 5.59 | 0.65 | 0.60 | 5.62 | 7.85 |
| 3 (comparison) | 4 | 0.03 | 5.58 | 0.66 | 0.48 | 5.12 | 6.97 |
| 7 (invention) | 4 | 0.03 | 5.55 | 0.68 | 0.55 | 5.02 | 7.24 |

Table 6 shows that developer solution 7 of the present invention, containing tetramethyl reductic acid compound as developing agent and Dimezone S as auxiliary developing agent, obtained good sensitometric results, comparable with those obtained by a standard graphic arts developer solution and better than those obtained by comparison developer solution 3, containing ascorbic acid as main developing agent.

A protective overcoat containing 1.2 g/m$^2$ gelatin was applied to each silver halide layer (Film 7).

Samples of Films 6 and 7 were exposed and developed (at 35° C. and for 20 seconds) using developer solutions 1 to 7 of Example 1 then fixed at 35° C. for 20 seconds in a 3M XS3 part A fixing solution. Table 8 reports the sensitometric results.

TABLE 8

| Developer Solutions | Films | Dmin | Dmax | Speed | Average Contrast |
|---|---|---|---|---|---|
| 2 (reference) | 6 | 0.23 | 3.38 | 2.00 | 2.25 |
| 3 (comparison) | 6 | 0.23 | 3.36 | 2.00 | 2.35 |
| 5 (invention) | 6 | 0.20 | 3.25 | 1.78 | 2.20 |
| 6 (invention) | 6 | 0.20 | 3.22 | 1.90 | 2.16 |
| 7 (invention) | 6 | 0.20 | 3.24 | 1.85 | 2.10 |
| 2 (reference) | 7 | 0.24 | 3.06 | 1.91 | 1.99 |
| 3 (comparison) | 7 | 0.24 | 3.04 | 1.92 | 1.87 |
| 7 (invention) | 7 | 0.22 | 2.91 | 1.76 | 1.71 |

Table 8 shows that developer solutions 5–7 of the present invention, containing tetramethyl reductic acid compound as developing agent, obtained good sensitometric results also when used to develop a radiographic film, the results being comparable to those obtained by a standard radiographic developer solution (reference 2).

We claim:

1. A black-and-white aqueous alkaline photographic developer composition, free of dihydroxybenzene developing agent, comprising a reductic acid developing agent and an auxiliary superadditive developing wherein the reductic acid developing agent is represented by the formula:

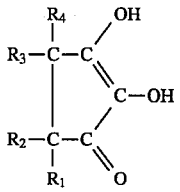

wherein, $R_1$, $R_2$, $R_3$ and $R_4$ each are selected from the group consisting of hydrogen and $CH_2R_5$, wherein $R_5$ is hydrogen or a monovalent group wherein said auxiliary superadditive developing agent is a 3-pyrazolidone developing agent.

2. Black-and-white aqueous alkaline photographic developer composition of claim 1 wherein said auxiliary superadditive developing agent is a 1-phenyl-3-pyrazolidone developing agent.

3. Black-and-white aqueous alkaline photographic developer composition of claim 1 wherein said auxiliary superadditive developing agent is a 1-phenyl-4,4-dimethyl-3-pyrazolidone developing agent.

4. Black-and-white aqueous alkaline photographic developer composition of claim 1 wherein said auxiliary superadditive developing agent is a 1-phenyl-4-methyl-4-hydroxymethyl-3-pyrazolidone developing agent.

5. Black-and-white aqueous alkaline photographic developer composition of claim 1 wherein the amount of said reductic acid derivative as developing agent is from about 0.02 to 0.8 moles per liter.

6. Black-and-white aqueous alkaline photographic developer composition of claim 1 wherein the amount of said reductic acid developing agent is from about 0.08 to 0.3 moles per liter.

7. Black-and-white aqueous alkaline photographic developer composition of claim 1 wherein the amount of said auxiliary developing agent is from about 0.0001 to 0. 15 moles per liter.

8. Black-and-white aqueous alkaline photographic developer composition of claim 1 wherein the amount of said auxiliary developing agent is from about 0.0025 to 0.1 moles per liter.

9. Black-and-white aqueous alkaline photographic developer composition of claim 1, additionally containing a buffering agent which is the carbonate compounds.

10. Black-and-white aqueous alkaline photographic developer composition of claim 1, additionally containing an antifogging agent comprising the alkali metal halides.

11. Black-and-white aqueous alkaline photographic developer composition of claim 1, additionally containing an antifogging agent comprising benzotriazole compounds.

12. Black-and-white aqueous alkaline photographic developer composition of claim 1, additionally containing an antioxidant compound comprising alkali metal sulfites.

13. Black-and-white aqueous alkaline photographic developer composition of claim 1, additionally containing a sequestering agent from the group consisting of aminopolycarboxylic acid compounds, a-hydroxycarboxylic acid compounds, dicarboxylic acid compounds, polyphosphate compounds and dialkylamino methane diphosphonic acid compounds.

* * * * *